US006845807B1

(12) United States Patent
Baltz et al.

(10) Patent No.: US 6,845,807 B1
(45) Date of Patent: Jan. 25, 2005

(54) METAL CASTING CORE ASSEMBLY FOR CASTING A CRANKSHAFT

(75) Inventors: Gene Frederic Baltz, Olmsted Falls, OH (US); Victor C. Zagorski, Northfield, OH (US)

(73) Assignee: Ford Motor Company, Dearborn, MI (US)

( * ) Notice: Subject to any disclaimer, the term of this patent is extended or adjusted under 35 U.S.C. 154(b) by 0 days.

(21) Appl. No.: 10/605,333

(22) Filed: Sep. 23, 2003

(51) Int. Cl.[7] ..... B22C 9/00

(52) U.S. Cl. ..... 164/28; 164/12; 164/98; 164/137; 164/339; 164/340; 164/341; 164/350; 164/351; 164/361

(58) Field of Search ..... 164/28, 12, 98, 164/137, 339, 340, 341, 350, 351, 369

(56) References Cited

U.S. PATENT DOCUMENTS 1,992,677 A * 2/1935 Sorensen ..... 164/350
3,965,962 A * 6/1976 Tanaka et al. ..... 164/55.1
5,280,822 A * 1/1994 Bullock ..... 164/369
5,495,885 A * 3/1996 Fowlkes et al. ..... 164/98
5,911,267 A * 6/1999 Witte et al. ..... 164/12
6,364,425 B1 * 4/2002 Marquis ..... 301/65

* cited by examiner

*Primary Examiner*—Kiley S. Stoner
*Assistant Examiner*—I.-H. Lin
(74) *Attorney, Agent, or Firm*—Brooks & Kushman PC; Raymond L. Coppiellie

(57) ABSTRACT

A core box assembly for casting a crankshaft. The core box assembly comprises axially aligned cores that define different axial portions of a cavity that receives molten metal to cast the crankshaft. Oil gallery cores are placed in the core box assembly to form as-cast oil galleries in the crankshaft. Heavy metal inserts are held by sand cores disposed in the portions of the cavity that form the counterweights of the crankshaft.

17 Claims, 13 Drawing Sheets

METAL CASTING CORE ASSEMBLY FOR CASTING A CRANKSHAFT

BACKGROUND OF INVENTION

1. Field of the Invention

The present invention relates to a sand core assembly for casting metal parts.

2. Background Art

Metal casting is a technique that may be used to form complex parts. The parts may be formed from ductile iron, aluminum or other metals. Examples of ductile iron castings include engine crankshafts, valve camshafts, engine blocks and other parts.

Conventional core boxes are generally formed with a clamshell design having two halves that are split longitudinally at a parting line. One problem with conventional core boxes and in particular with regard to core boxes for casting crankshafts is that it is difficult to maintain dimensional accuracy in the final cast part. Conventional cast crankshafts require substantial machining to form a flange hub pilot hole, oil gallery passages and shape counter-weights. In conventional core boxes a three degree draft angle is provided on counter-weight cheeks and substantial machining or "cheeking," is required to eliminate the draft angle. It is also necessary to drill pilot holes and oil gallery passages in the crankshaft casting.

Another problem with conventional casting processes is that the cast parts generally must be homogeneous as cast and do not permit selectively weighting portions of counter-weights with dissimilar materials without further machining and assembly.

Conventional casting also results in flash being formed that must be removed in a cleaning process and consequently adds expense to the casting process. Molding parting lines may also interfere with machining operation clamping points.

Machining variations can also cause problems relating to balancing the crankshaft. Normally, a window is provided as to the degree of balance of the shaft that is acceptable. The window is reduced when it is necessary to account for machining variation.

A need exists for a casting process for a complex rotatable shaft, such as a crankshaft or a camshaft. There is also a need for a casting process wherein the complex shaft can be formed accurately with no draft, and including "as cast" oil galleries and other features. A process is needed wherein a core may be inserted into a cope/drag core package allowing for a no-flash mold line without green sand. There is also a need for a process utilizing a unitized core package that may be easily integrated into a robotic or automatic system. Finally, there is a need for a core that may be used to make complex shafts that vents well and produces fewer casting gas inclusions.

The above problems and long felt needs are addressed by Applicant's invention as summarized below.

SUMMARY OF INVENTION

According to one aspect of the present invention a metal casting core assembly for casting a crankshaft is provided that comprises a plurality of axial segment sand cores each having an interior opening for receiving molten metal to form different axially aligned portions of the crankshaft. The sand cores are each aligned along a central axis.

According to a further aspect of the invention, a plurality of core bolt holes that are axially aligned as the core assembly is assembled. Each of the core bolt holes receive a core bolt that extends parallel to the central axis. The core bolts are each secured with a retaining nut to hold the core assembly together to apply a compressive load.

According to another aspect of the present invention, a plurality of oil gallery cores are assembled to the sand cores in core prints, or cut-outs, formed in the sand cores. Each of the oil gallery cores extend through at least one of the interior openings in the sand cores to define an oil gallery in the crankshaft. The oil gallery cores are preferably formed of high temperature resin bonded sand. The oil gallery cores include at least one elongated body portion and anchoring portions on each end of the body portions. The anchoring portions are received in cut-outs formed in the sand cores. The cut-outs are shaped to correspond to and receive one of the anchoring portions. The anchors may be tapered to form a narrow side that is received in the base of the cut-out and a wider side at a mating surface of the sand core in which the anchoring portion is received.

According to other aspects of the invention the sand cores each have at least one mating surface that is placed face-to-face with a mating surface of an adjacent sand core. A first set of the mating surfaces has at least one locator pin that is received in corresponding locator pin recesses formed on the second set of mating surfaces. Locator pins are received in the locator pin recesses to locate adjacent sand cores relative to each other.

According to another aspect of the invention relating to insert weights, an insert made of a metal composition that has a different mass than the molten metal used to form the crankshaft may be molded into a part of the crankshaft such as the counter-weight. Sand positioning members may be secured between the sand cores and the insert to retain the insert within one of the interior openings prior to filling the core with molten metal.

Other aspects of the invention relate to manufacturing of a crankshaft for an engine. The invention may be applied to 4, 6, 8, 10 or 12 cylinder engine crankshafts. In the illustrated embodiment, a V-6 crankshaft may be made with eleven cores that are arranged along the rotational axis of the crankshaft wherein the first core has an interior opening defining a post end of the crankshaft, a first main bearing and part of a first counter-weight. The second sand core has two sides with an interior opening defining on a first side a first connecting rod pin and a part of a first counter-weight and on a second side thereof a part of the second counter-weight. A third sand core has two sides and an interior opening defining on a first side a fourth connecting rod pin and part of the second counter-weight and on a second side part of a third counter-weight. The fourth sand core defines on a first side a second main bearing journal and part of the third counter-weight and on a second side part of a fourth counter-weight. A fifth sand core has two sides with an interior opening defining on a first side a second connecting rod pin and a part of the fourth counter-weight and on a second side part of a fifth counter-weight. A sixth one of the sand cores has two sides with an interior opening defining on a first side a fifth connecting rod pin and a part of the fifth counter-weight and on a second side part of the sixth counter-weight. The seventh sand core has two sides with an interior opening defining on a first side a third main journal bearing and a part of a sixth counter-weight and on the second side part of a seventh counter-weight. The eighth sand core has two sides with an interior opening defining on its first side a third connecting rod pin and a part of the seventh counter-weight and on its second side part of an eighth counter-weight. The ninth sand core has two sides with an interior opening defining on a first side a sixth connecting rod pin and part of the eighth counter-weight and on the second side part of a ninth counter-weight. The ninth sand core further comprises a connecting rod pin lightener sand core that is secured to the first side of the ninth core in the interior opening. A tenth sand core has two sides with an interior opening defining on a first side a main bearing journal and a part of the ninth counter-weight and on a second side a part of the flywheel hub. Finally, the eleventh sand core has an interior opening defining part of a flywheel hub and a metal in-gate ported to the interior opening and further comprising a flywheel hub pilot bearing lightener core.

These and other aspects of the present invention will be better understood in view of the attached drawings and following detailed description of the best mode for carrying out the invention.

DETAILED DESCRIPTION

Figure 1:
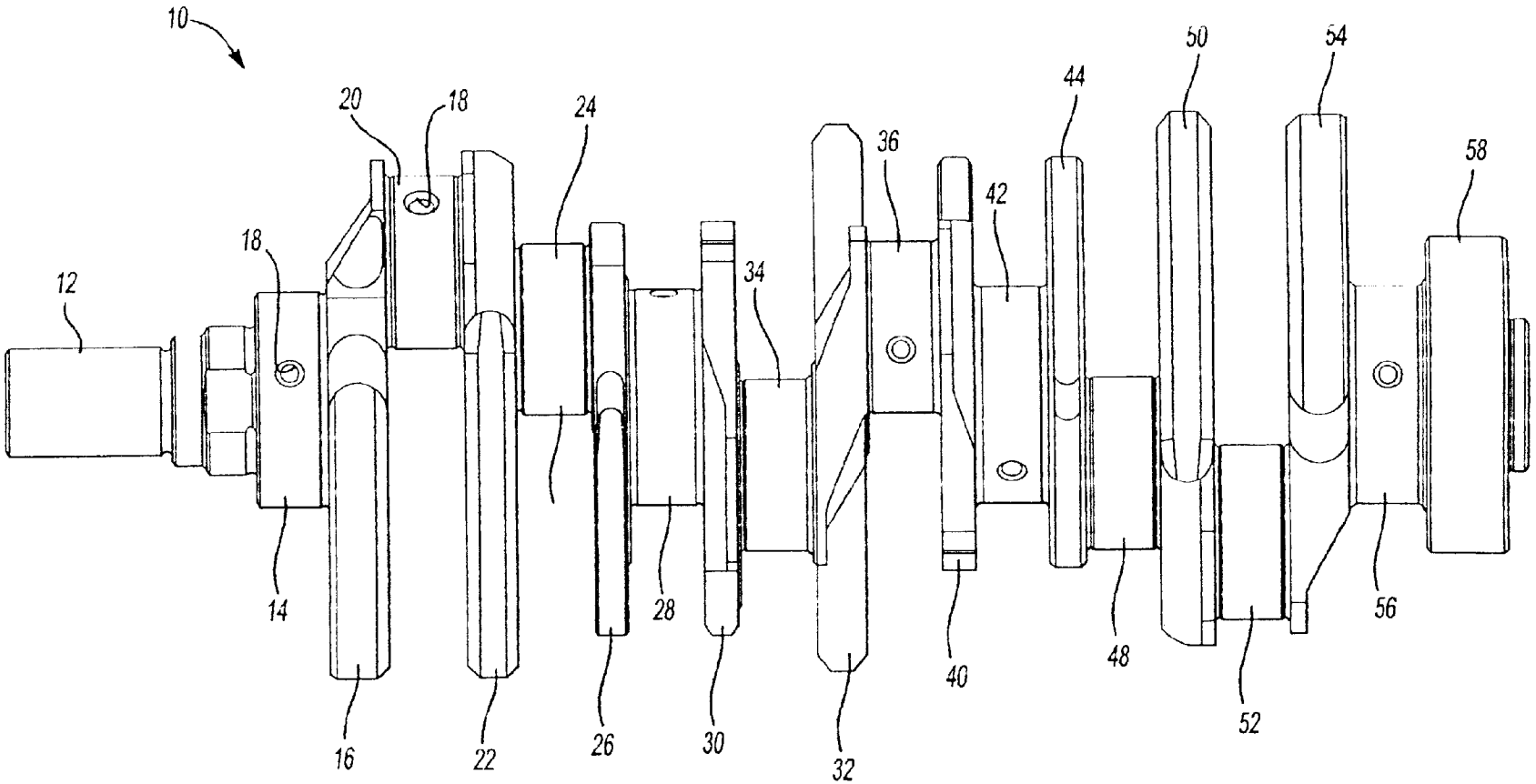
FIG. 1 is an elevation view of a crankshaft for a V-6 engine made according to the present invention.

Referring now to FIG. 1, a crankshaft 10 for a V-6 engine that may be made according to the present invention is illustrated. The crankshaft 10 has a post end 12 and first main bearing journal 14 that is adjacent to a first counterweight 16. An oil gallery passage 18 opens into the first main bearing journal 14 and extends to a first connecting rod pin 20. The oil gallery passage 18 distributes oil to bearings at desired locations on the crankshaft 10.

The first connecting rod pin 20 is adapted to receive the end of a piston connecting rod and is disposed between the first counterweight 16 and a second counterweight 22. A fourth connecting rod pin 24 is disposed between the second counterweight 22 and a third counterweight 26. A second main bearing journal 28 is located between the third counterweight 26 and a fourth counterweight 30. A fifth counterweight 32 is provided on the opposite side of a second connecting rod pin 34. The second connecting rod pin 34 is disposed between fourth counterweight 30 and fifth counterweight 32. A fifth connecting rod pin 36 is provided between the fifth counterweight 32 and a sixth counterweight 40. A third main bearing journal 42 is provided adjacent the sixth counterweight 40 and a seventh counterweight 44. A third connecting rod pin 48 is provided between the seventh counterweight 44 and an eighth counterweight 50. A sixth connecting rod pin 52 is provided between the eighth counterweight 50 and a ninth counterweight 54. A fourth main bearing journal 56 is provided between a flywheel hub 58 and the ninth counterweight 54. The flywheel hub 58 is provided on the crankshaft 10 adjacent the flywheel of the engine, not shown.

Figure 2:
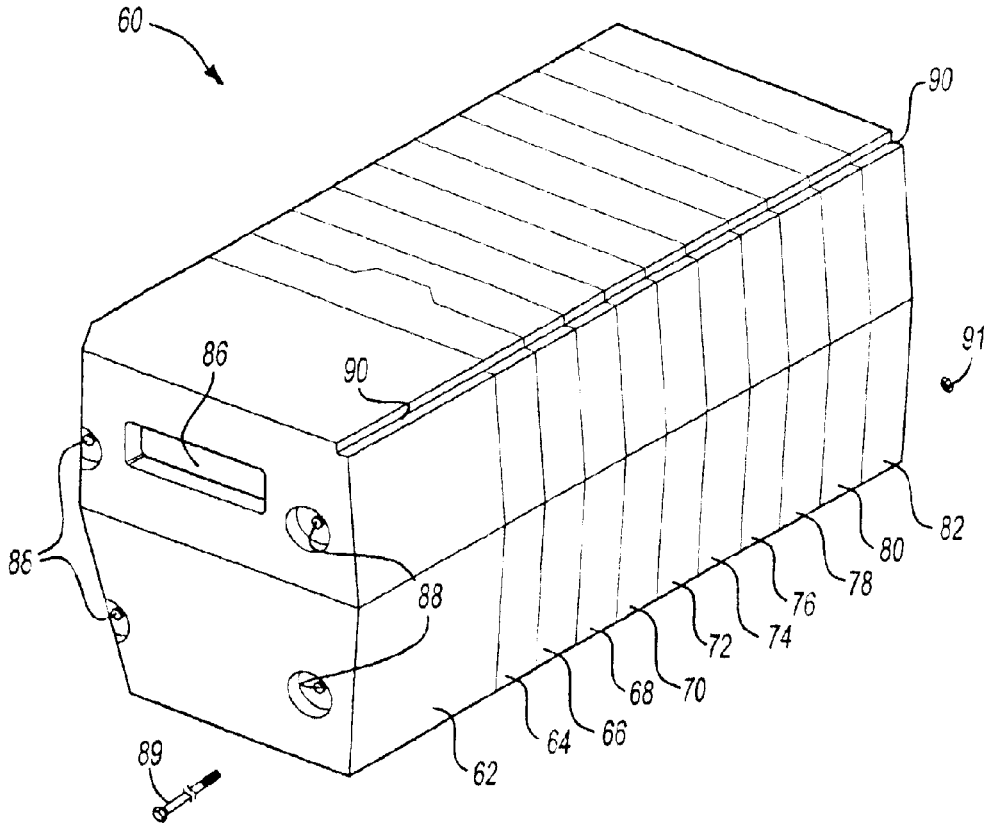
FIG. 2 is a perspective view of a core package.

Referring to FIG. 2, core box assembly 60 is shown assembled together ready for placement in a cope/drag mold. The core box assembly 60 include a first sand core 62 that is assembled to a second sand core 64. First through eleventh sand cores 62–82 are assembled in a side-by-side relationship to form the core box assembly 60. The core box 60 may include a handle 86 that is used to facilitate carrying the core box either manually or by means of automated casting line equipment. A plurality of fastener recesses 88 are provided on both the first sand core 62 and the eleventh sand core 82 through which fasteners such as a core bolt 89 with a nut 91 is inserted to secure the core box assembly 60 together. A corner notch 90 is provided to facilitate assembly of the core box assembly 60. The corner notches 90 of each of the sand cores 62–82 are aligned only when the core box assembly 60 is properly assembled.

Figure 3:
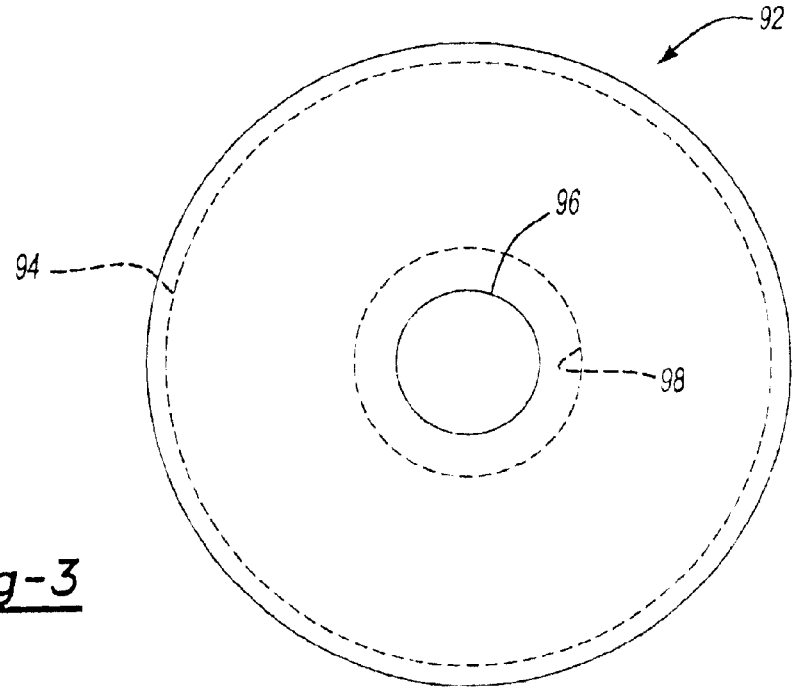
FIG. 3 is an elevation view of a heavy metal insert that may be cast in place to form part of a counterweight of the crankshaft.

Referring to FIG. 3, a heavy metal insert 92 is illustrated that may be molded into the cast crankshaft 10 at a desired location. The heavy metal inserts 92 may be provided to add weight to counterweights. Heavy metal insert 92 is preferably made from tungsten steel but may also be made of other materials that have a different mass than the ductile iron used to form the other parts of the crankshaft 10. Heavy metal insert 92 has a circumferential slot 94 that extends about its circumference and is filled with ductile iron as the crankshaft 10 is molded in the core box assembly. The insert 92 is held in place by sand cores within the core box assembly 60. A small sand core recess 96 is provided on one side of the insert 92 and a large sand core recess 98 is provided on the opposite side of the insert 92. The insert is retained by sand cores as will be described below with reference to FIGS. 8 and 9.

Figure 4:
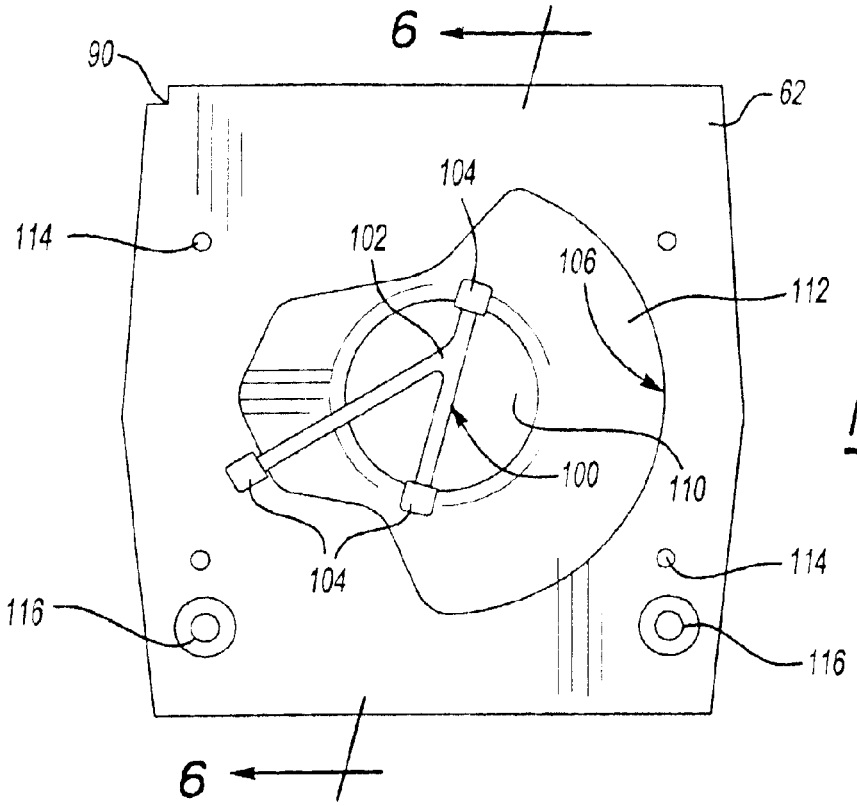
FIG. 4 is an end elevation view of one side of core number one.

Referring to FIG. 4, the first sand core 62 is shown to include an oil gallery sand core 100. The oil gallery sand core 100 includes a body portion 102 and anchors 104 that anchor the sand core 100 to the first sand core 62 so that the body portion 102 extends across a casting cavity 106 in which molten metal is to be poured. In the exemplary embodiment shown, five oil gallery sand cores are provided that are shaped differently to form oil galleries in different locations. The component parts of the oil gallery sand cores have the same reference numerals for simplicity. The oil gallery sand core 100 is provided to eliminate the need to drill an oil gallery in the finished crankshaft 10 that previously required boring with expensive rifle drills. The casting cavity 106 includes a first main bearing journal portion 10 and a first counterweight portion 112. In the exemplary embodiment shown, four bolt holes 114 are provided in which long core bolts 89 are inserted to secure the cores together to form the core box assembly 60.

Figure 5:
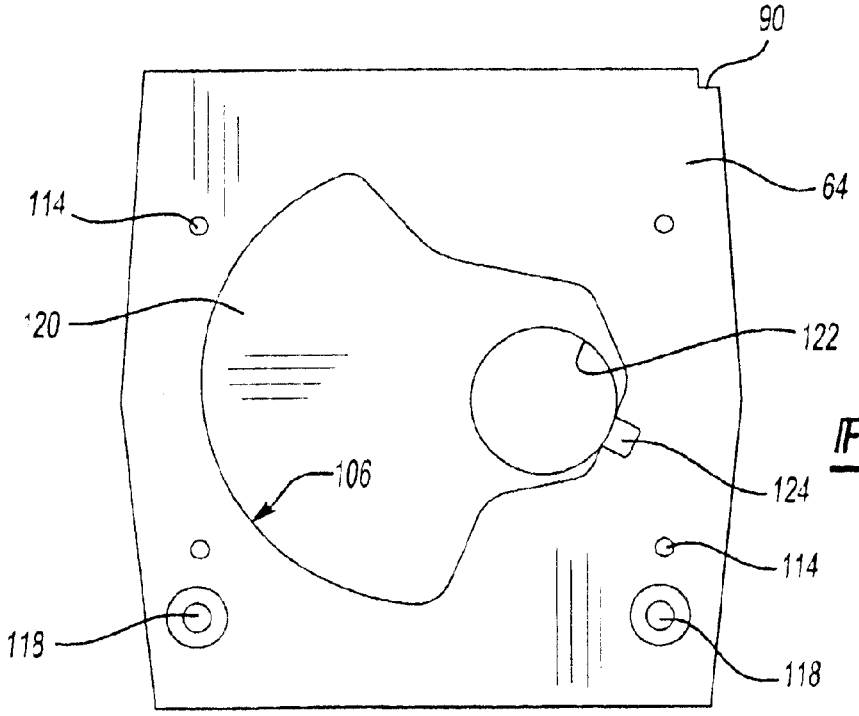
FIG. 5 is an end elevation view of a first side of core number two.
Figure 7:
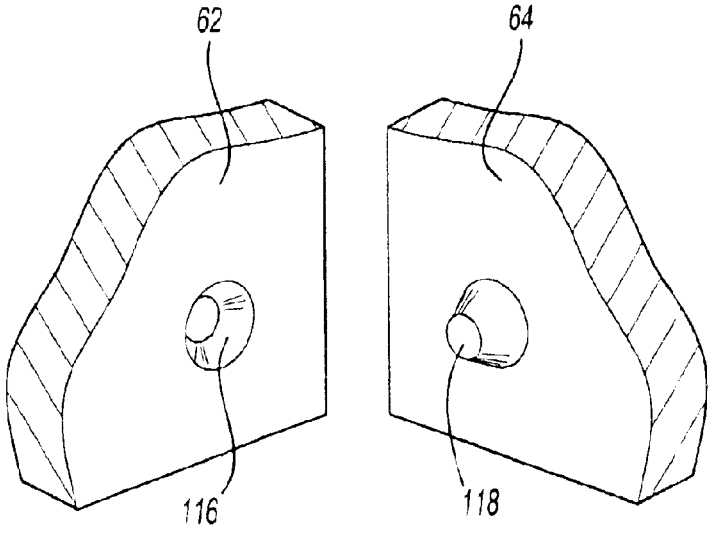
FIG. 7 is a fragmentary perspective view of a locator pin and locator pin receptacle.

Referring to FIGS. 4, 5 and 7, locator pin receptacles 116 receive locator pins 118 when the first and second sand cores 62 and 64 are secured together in a face-to-face relationship. The locator pin receptacles 116 receive the locator pin 118 as best seen in FIG. 7.

Referring to FIG. 5, one side of the second sand core 64 is illustrated. The casting cavity 106 visible from this side of the second sand core 64 defines first counterweight portion 120 that together with first counterweight portion 112 defines the shape of the first counterweight 16. The second sand core also defines as part of the casting cavity 106 a first connecting rod pin portion 122. Also shown in FIG. 5 is a cut out 124, or core print, that receives the anchor 104 of the oil gallery sand core 100 that is shown in FIG. 4 as part of the first sand core.

Figure 6:
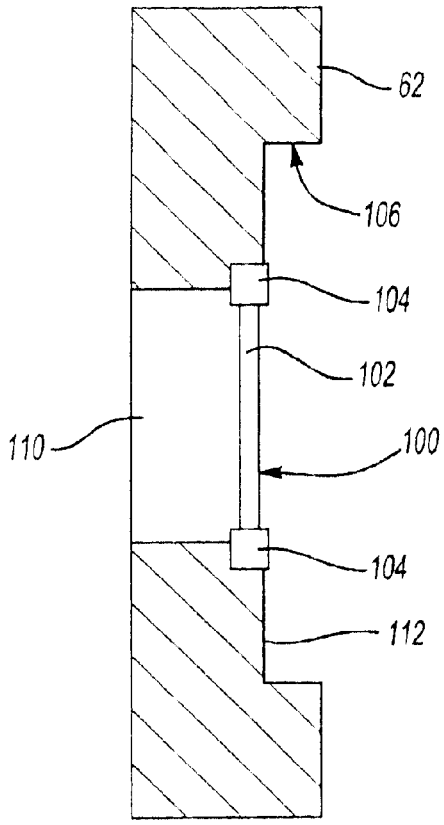
FIG. 6 is a cross sectional view of an oil gallery core in core number one taken along line 6—6 in FIG. 4.

Referring to FIG. 6, the relationship of the oil gallery sand core 100 and first sand core 62 are illustrated in cross section. The oil gallery sand core 100 includes a body portion 102 and a plurality of anchors 104 that secure the sand core 100 to the first sand core 62 inside the casting cavity 106. The body portion 102 of the oil gallery sand core 100 forms a passageway through the crankshaft without the need to drill the crankshaft after forming. After the crankshaft 10 is cast it is removed from the core block 60 and the oil gallery sand core 100 may be removed by mechanical impacting and shot blasting which are existing foundry practice.

Figure 8:
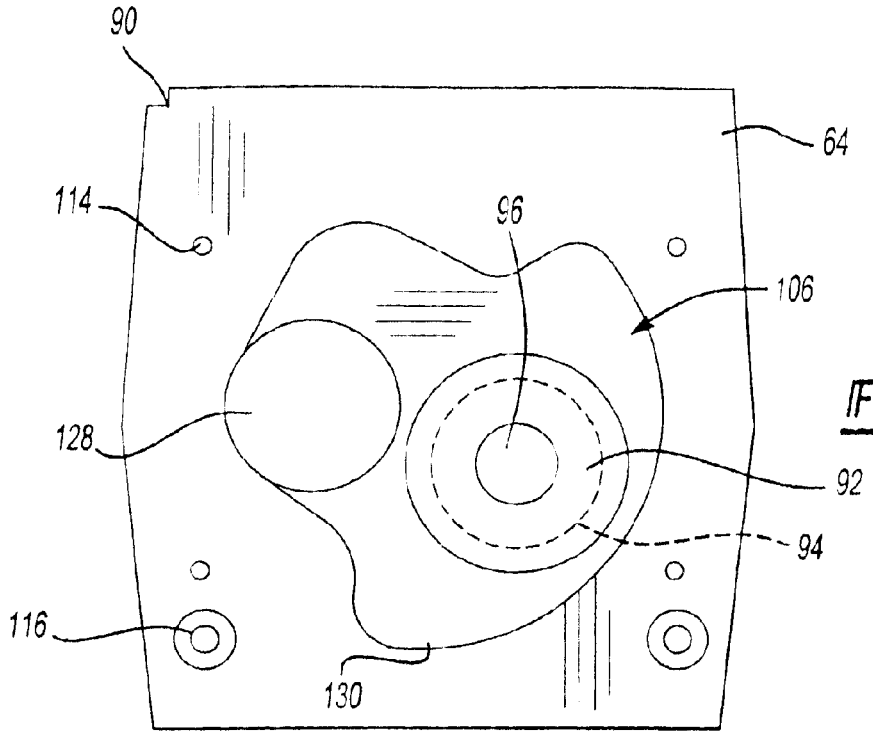
FIG. 8 is an end elevation view of a second side of core number two.

Referring to FIG. 8, the other side of the second sand core 64 is shown. On this side of the second sand core 64 the casting cavity 106 defines a first connecting rod pin portion 128 and a second counterweight portion 130. The second counterweight portion 130 may receive an insert weight 92 made of heavy metal such as a tungsten steel. The insert weight 92 is held in place by a sand positioning pin 134 that is received in the small sand core recess 96, as shown in FIG. 3. The heavy metal insert 92 is positioned on a sand positioning pin 134 on one side and a similar larger sand positioning pin (not shown) on the opposite side. The insert 92 as shown is designed to be located in the second counterweight 130 to provide increased mass to afford added counterbalance to the crankshaft. Weight can be added to a specific counter-weight or several counterweights. With the insert 92 the crankshaft can be provided with the desired mass in a certain area of the crankshaft while allowing other areas of the crankshaft to be reduced in mass. The insert weight 92 may consist of a machined disk of tungsten steel. Molten metal is permitted to flow around the insert 92 and into the circumferential slot 94 to mechanically hold it internally within the counterweight. The insert 92 is held in position by a core sand locator pin 134 on one side of the counterweight and may also be held in position by a second core sand locator pin that engages an adjacent core. When metal fills the cavity the insert weight 92 becomes an integral part of the counterweight. While it is known to add heavy metal inserts to a crankshaft, in the prior art it was done by drilling the crankshaft and press fitting a round heavy metal plug into the drilled hole. According to the present invention the insert weight 92 is cast into the counterweight during the metal pouring process without requiring drilling or an assembly operation.

Figure 9:
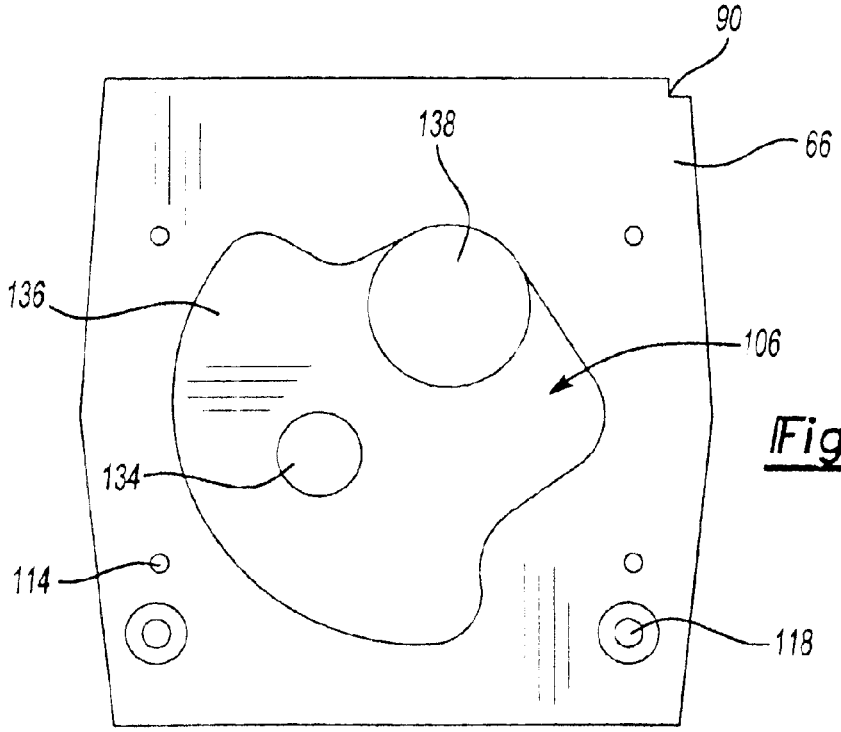
FIG. 9 is an end elevation view of a first side of core number three.

Referring to FIG. 9, one side of the third sand core 66 is shown wherein the sand positioning pin 134 is disposed in the casting cavity 106. The casting cavity 106 defines second counterweight portion 136 and a fourth connecting rod pin portion 138.

Figure 10:
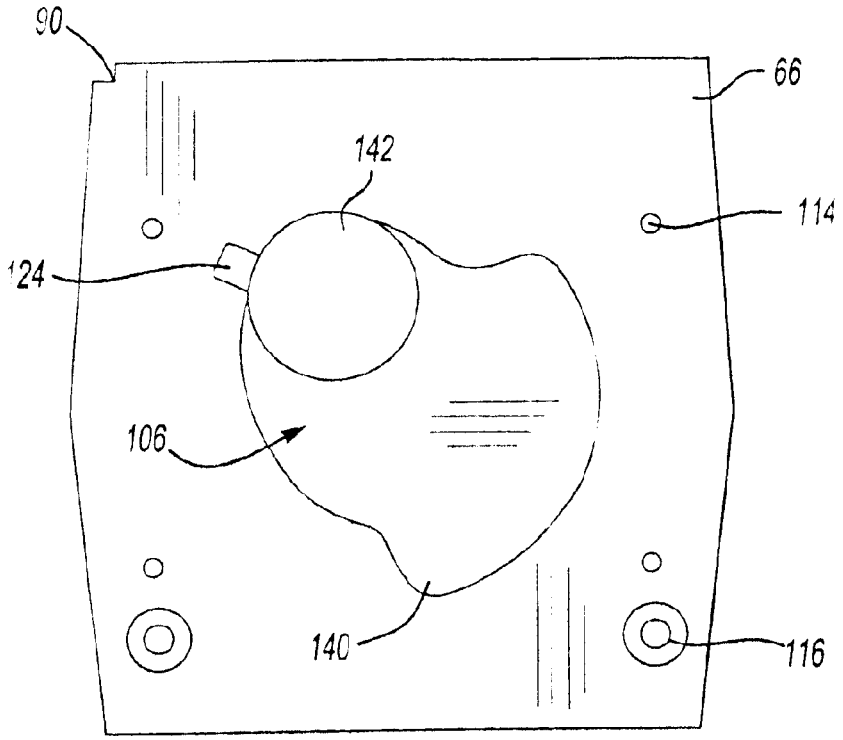
FIG. 10 is an end elevation view of a second side of core number three.

Referring to FIG. 10, the other side of the third sand core 66 is illustrated wherein the casting cavity 106 defines a third counterweight portion 140 and fourth connecting rod pin portion 142. A cut out 124 is provided for receiving an anchor portion 104 of the oil gallery sand core 100 that is shown in FIG. 11 and described below.

Figure 11:
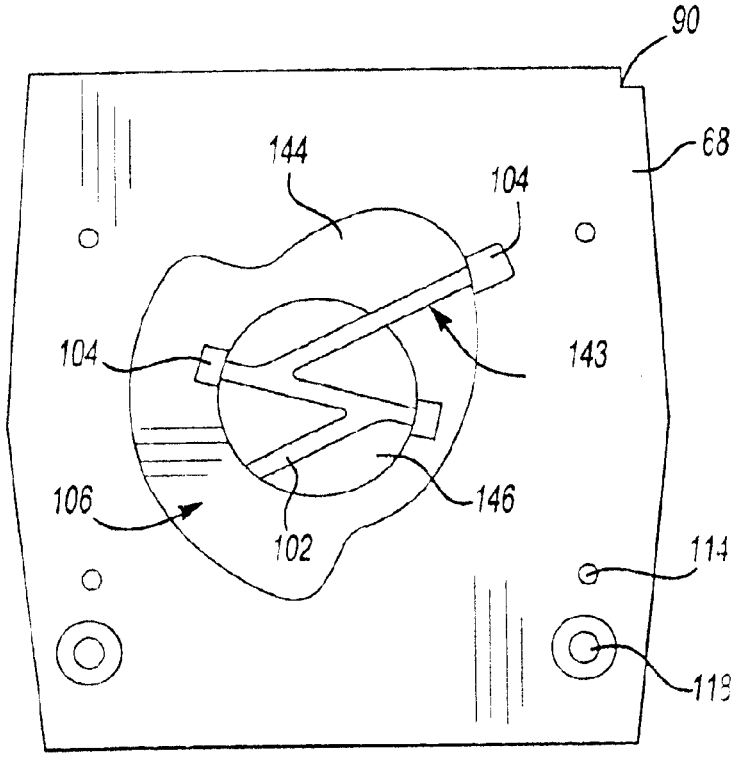
FIG. 11 is an end elevation view of a first side of core number four.

Referring to FIG. 11, one side of fourth sand core 68 is illustrated with a multiple passage oil gallery sand core 143 disposed in the casting cavity 106. The casting cavity 106 defines a third counterweight portion 144 and a second main bearing journal portion 146. The oil gallery sand core 143 extends through the casting cavity 106 to define a complex oil gallery passage.

Figure 12:
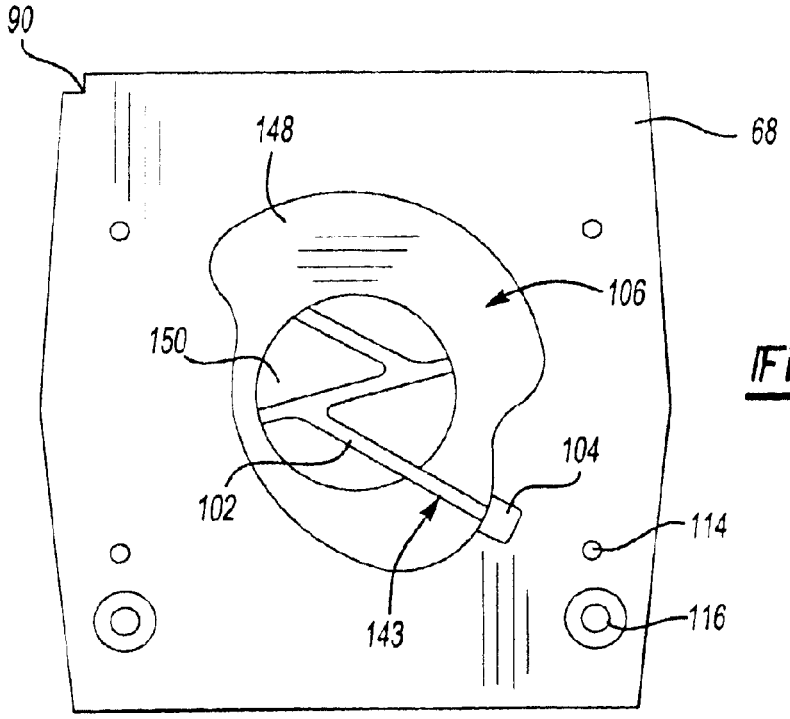
FIG. 12 is an end elevation view of a second side of core number four.

Referring to FIG. 12, a second side of the fourth sand core 68 is shown in conjunction with the oil sand core 143. The casting cavity 106 defines fourth counterweight portion 148 and a second main bearing journal portion 150. The oil gallery sand core 143 extends through a fourth counterweight portion 148 and a second main bearing journal portion 150.

Figure 13:
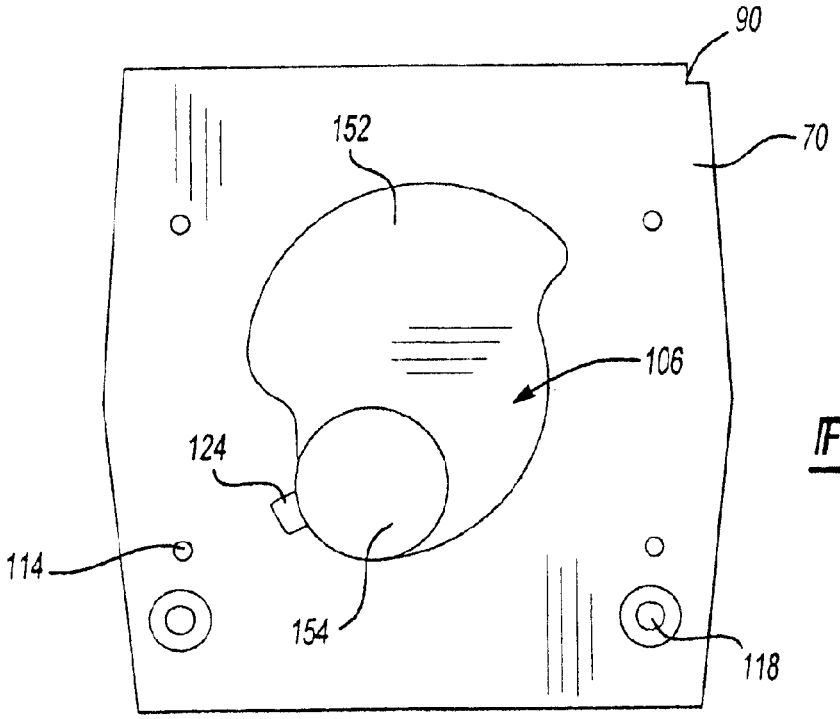
FIG. 13 is an end elevation view of a first side of core number five.

Referring to FIG. 13, one side of fifth sand core 70 is illustrated. The casting cavity 106 defines fourth counterweight portion 152 and a second connecting rod pin portion 154. A cut out 124, or core print, is provided in the body of the fifth sand core 70 to receive the anchor 104 as shown in FIG. 12 when the sand cores are placed side by side with the corner notches 90 in alignment.

Figure 14:
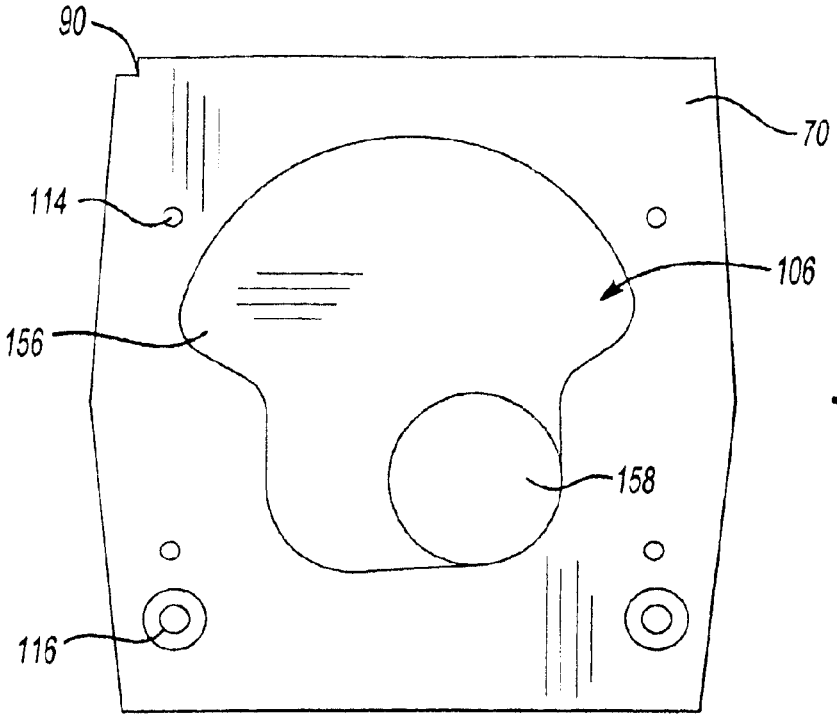
FIG. 14 is an end elevation view of a second side of core number five.

Referring to FIG. 14, the other side of the fifth sand core 70 is shown. The casting cavity 106 defined by this side of the fifth sand core 70 defines a fifth counterweight portion 156 and a second connecting rod pin portion 158.

Figure 15:
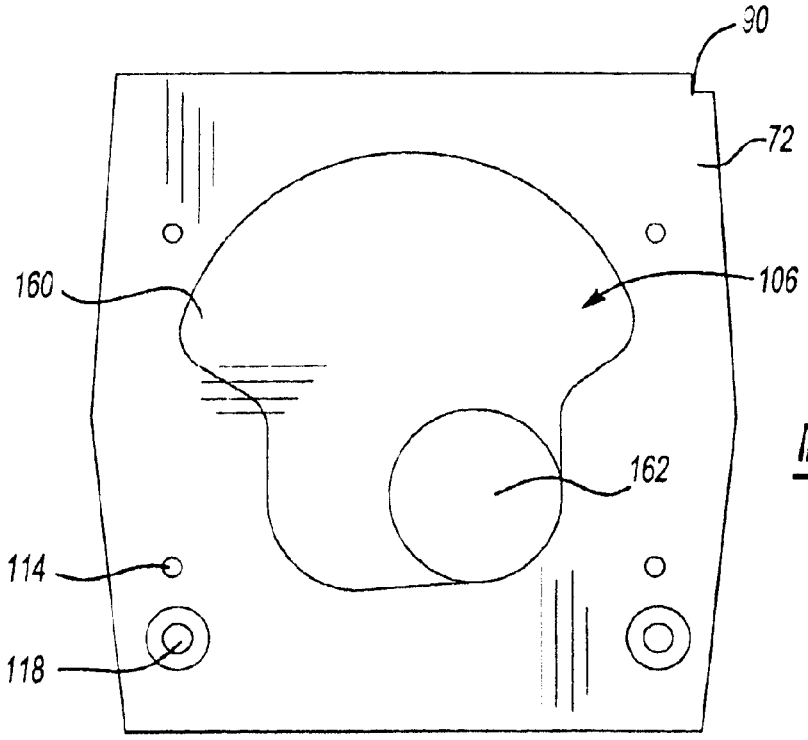
FIG. 15 is an end elevation view of a first side of core number six.

Referring to FIG. 15, one side of sixth sand core 72 is illustrated. The portion of the casting cavity 106 defined by this side of the sixth sand core 72 defines a fifth counterweight portion 160 and a fifth connecting rod portion 162.

Figure 16:
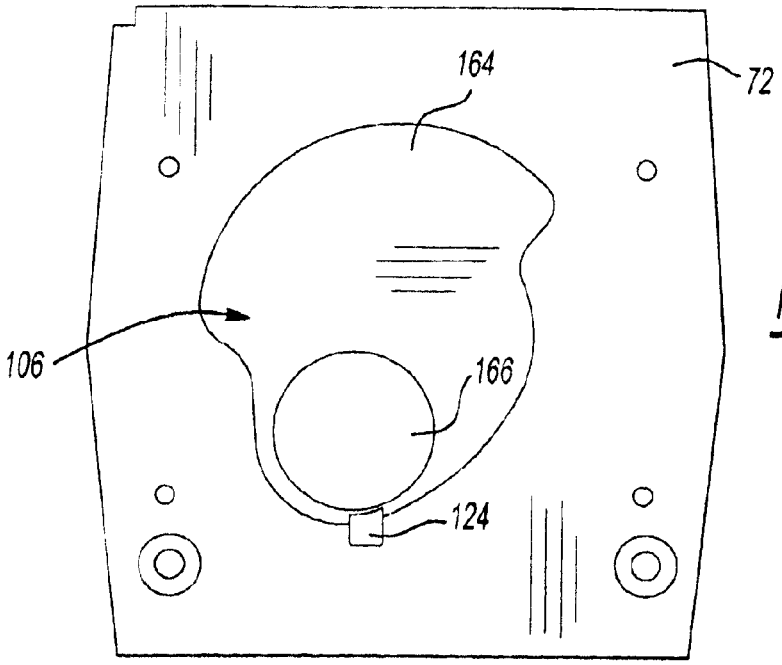
FIG. 16 is an end elevation view of a second side of core number six.

Referring to FIG. 16, the second side of sixth sand core 72 is shown wherein the casting cavity 106 defines a six counterweight portion 164 and a fifth connecting rod pin portion 166. A cut out 124 is also visible in FIG. 16 that receives one anchor of an oil gallery sand core 167 as illustrated in FIG. 17.

Figure 17:
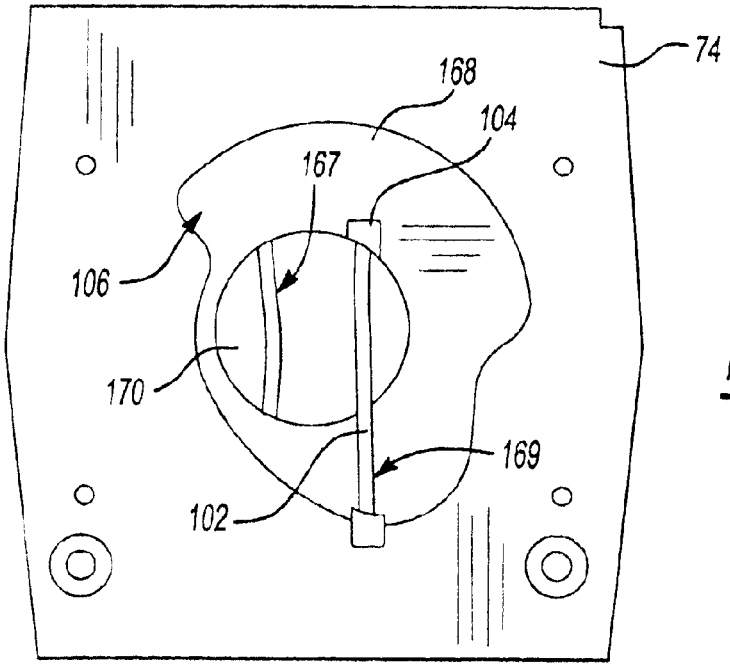
FIG. 17 is an end elevation view of a first side of core number seven.

Referring to FIG. 17, one side of seventh sand core 74 is shown in conjunction with two oil gallery sand cores 167 and 169 one of the oil gallery sand cores 169 is disposed in the casting cavity 106 that defines a sixth counter-weight portion 168 and a third main bearing journal portion 170. The other oil gallery sand core 167 visible in FIG. 17 is disposed in the portion of the cavity that is better seen in FIG. 18.

Figure 18:
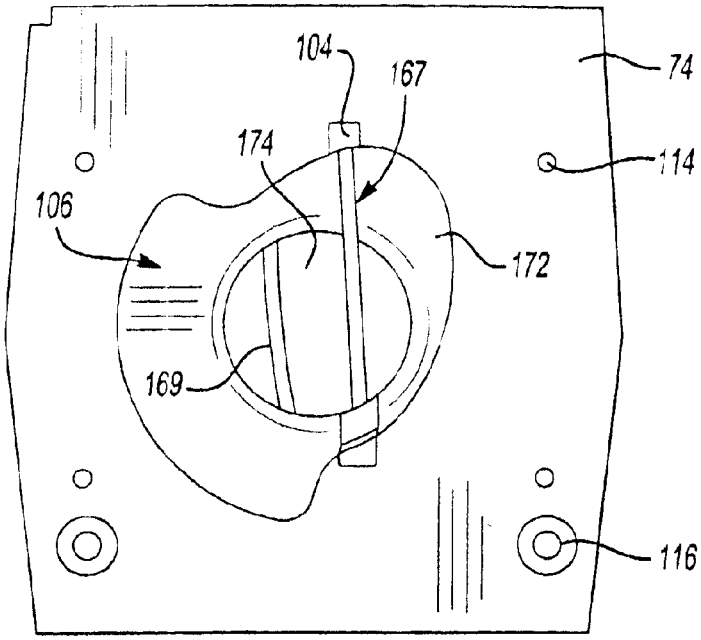
FIG. 18 is an end elevation view of a second side of core number seven.

Referring to FIG. 18 the other side of the seventh sand core 74 is illustrated. The casting cavity 106 defines a seventh counterweight portion 172 and a third main bearing journal portion 174. Oil gallery sand core 167 spans the casting cavity.

Figure 19:
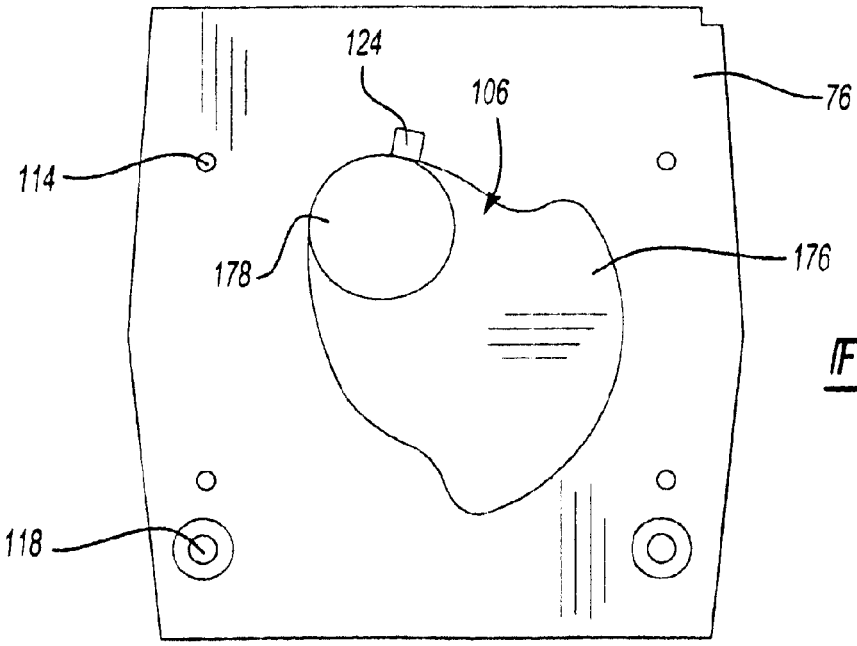
FIG. 19 is an end elevation view of a first side of core number eight.

Referring to FIG. 19 one side of an eighth sand core 76 is illustrated including a portion of the casting cavity 106 that defines a seventh counterweight portion 176 and a third connecting rod pin portion 178. A cut out 124 is provided to receive one of the anchors 104 of the oil gallery sand core 167, shown in FIG. 18.

Figure 20:
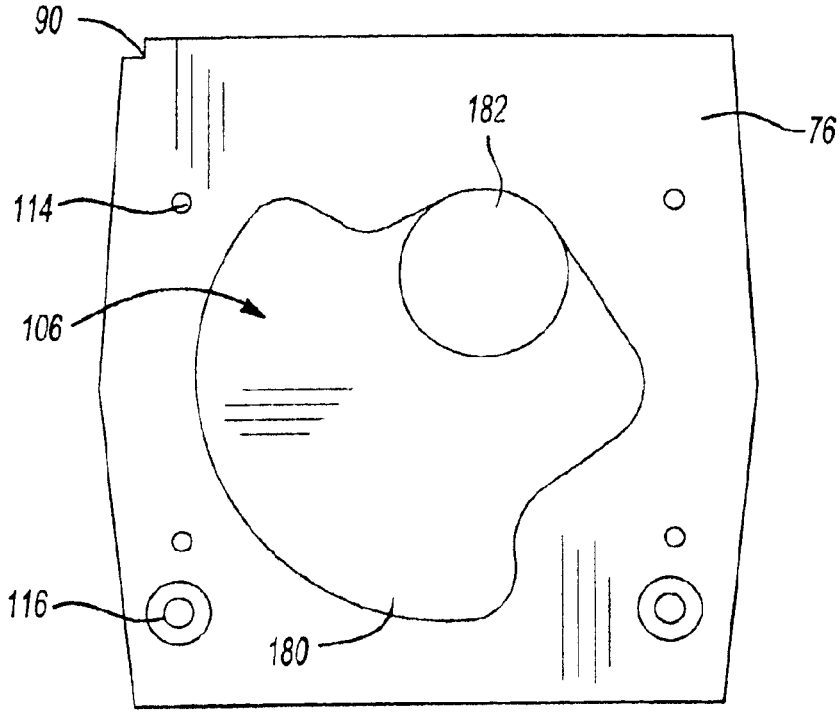
FIG. 20 is an end elevation view of a second side of core number eight.

Referring to FIG. 20, the other side of the eighth sand core 76 is illustrated. The portion of the casting cavity 106 defined by this side of the eighth sand core 76 defines an eighth counterweight portion 180 and a third connecting rod pin portion 182.

Figure 21:
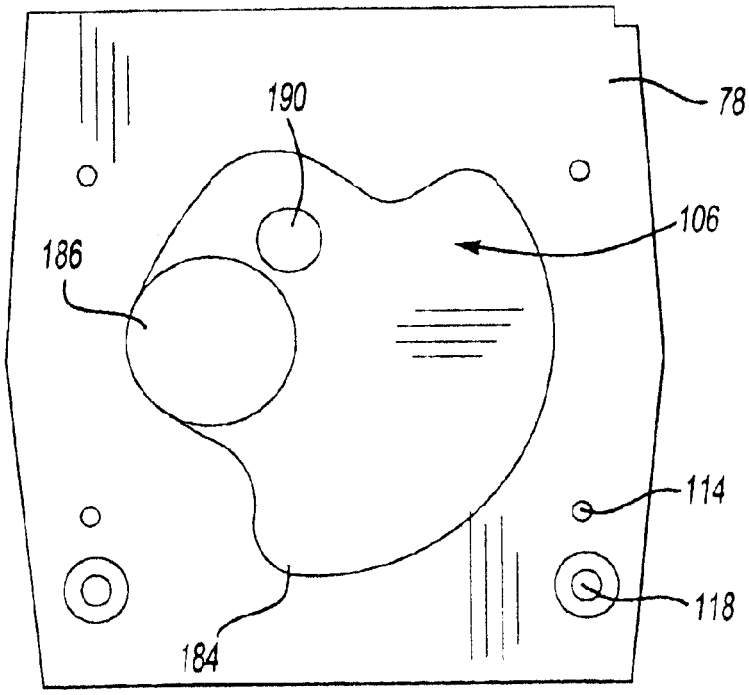
FIG. 21 is an end elevation view of a first side of core number nine.

Referring to FIG. 21, one side of the ninth sand core 78 is illustrated. The portion of the casting cavity 106 defined by this side of the ninth sand core 78 defines an eighth counterweight portion 184 and a sixth connecting rod pin portion 186. A connecting rod pin lightener core 190 is also illustrated. The connecting rod pin lightener core 190 cores out the connecting rod pin 182 to provide for removal of metal mass for reduced weight of the crank pins. Metal may be removed from connecting rod pins without using a separate core. The shape of the connecting rod pin lightener core 190 can be an integral part of the main core. The lightener core 190 must be shaped to provide adequate clearance so that it does not interfere with a oil gallery core. The lightener core 190 can be used to remove mass from the connecting rod journal.

Figure 22:
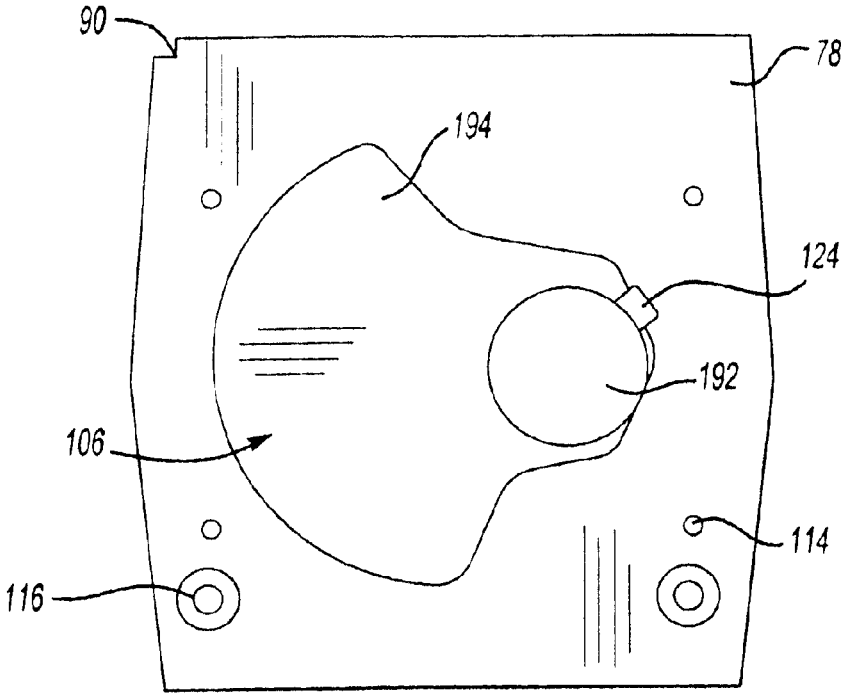
FIG. 22 is an end elevation view of a second side of core number nine.

Referring to FIG. 22, the other side of the ninth sand core 78 is illustrated. The portion of the casting cavity 106 defined by this side of the ninth sand core 78 defines a sixth connecting rod pin portion 192 and a ninth counterweight portion 194. Cut out 124 is provided to receive an anchor 104 of the oil gallery sand core 100, as illustrated in FIG. 23.

Figure 23:
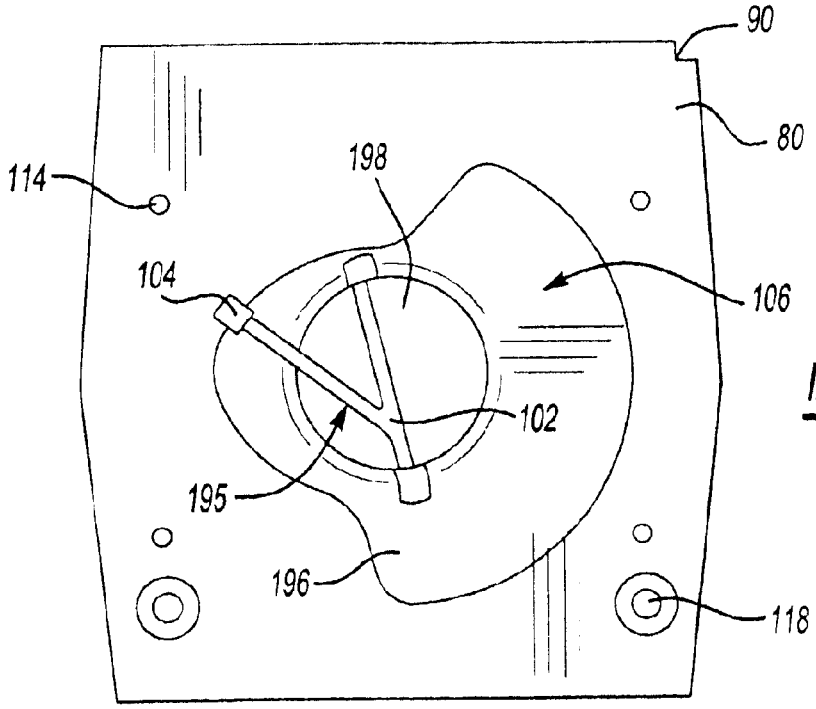
FIG. 23 is an end elevation view of a first side of core number ten.

Referring to FIG. 23, one side of the tenth sand core 80 is illustrated with an oil gallery sand core 100 referred to above in connection with FIG. 22. The casting cavity 106 in this side of the tenth sand core 80 defines a ninth counterweight portion 196 and a fourth main bearing journal portion 198.

Figure 24:
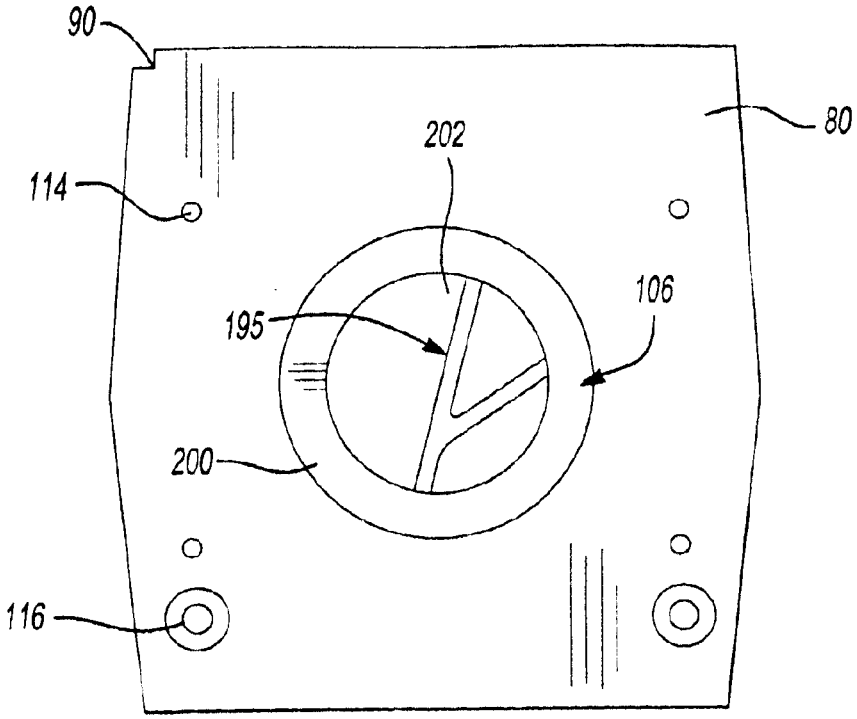
FIG. 24 is an end elevation view of a second side of core number ten.

Referring to FIG. 24 the other side of the tenth sand core 80 is shown to include a portion of the casting cavity 106 that defines a flywheel hub portion 200 and a fourth main bearing journal portion 202.

Figure 25:
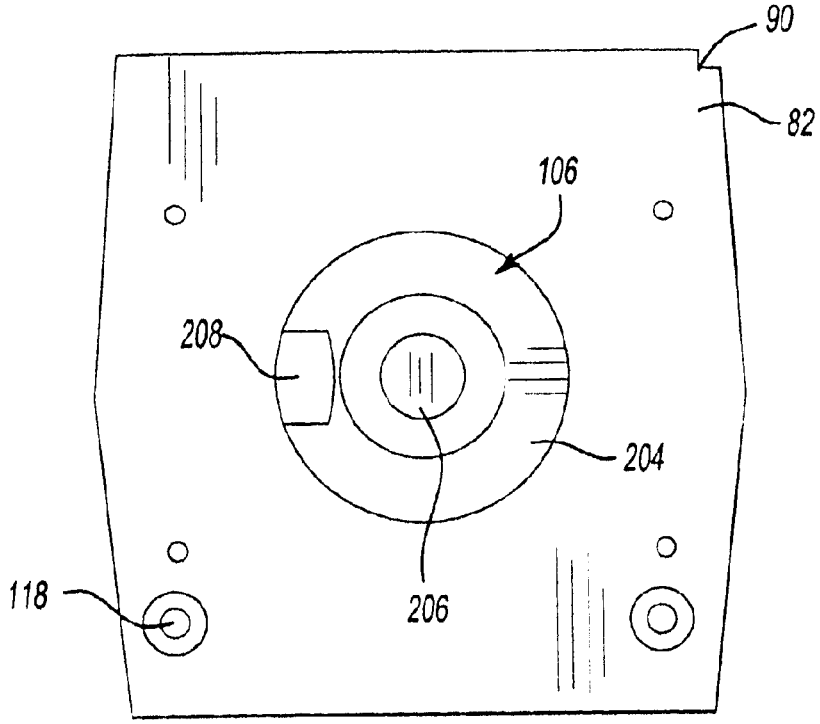
FIG. 25 is an end elevation view of one side of core number eleven.

Referring to FIG. 25, one side of eleventh sand core 82 is illustrated. The casting cavity terminates in the eleventh sand core 82 and defines a flywheel hub portion 204 and a flywheel hub pilot bearing lightener core 206. A metal in-gate 208 is also shown through which molten metal is poured into the casting cavity 106 to fill the casting cavity as defined by the first through eleventh sand cores 62–82. The lightener core 206 is provided at the center of the flywheel hub and also provides a shape of the pilot bearing hole in an "as cast" configuration to reduce the amount of metal that must be machined from the pilot hub.

A metal in-gate 208 allows metal to enter the casting and be cast into a prescribed shape to control metal inflow into the core package during the metal pouring operation. The in-gate connects to the gating and riser system of the cope and drag mold. The in-gate is defined by the core package to allow for the metal gating system to be easily separated from the casting by fracturing the in-gate sprue with a mechanical impact. The casting can be easily separated from the gating system with a clean fracture break that requires no additional finishing or grinding.

One embodiment of a method for making an engine crankshaft with the metal casting core assembly can be summarized as follows. First, a suitable material like sand is coated with a resin, such as a urethane resin. Next, the resin coated sand is blown into each of the core boxes such that each core box forms an axial segment of the crankshaft. More specifically, each core box is radially split from adjacent core boxes of a core box assembly and includes a cavity that includes a portion of the desired crankshaft geometry. The resin coated sand is allowed to set in the core boxes so that it may retain the desired configuration. Setting the resin may include injecting a catalyst gas into the core boxes to set off the resin and venting the catalyst gas through a vent screed. After the sand is set, the oil gallery cores are installed in one or more of the core boxes as previously discussed. Next, the plurality of core boxes are assembled to form a core box assembly. This assembly step may include positioning a locator pin receptacle to receive a locator pin disposed on an adjacent core box as previously described. The core box assembly is secured together with one or more elongated fasteners, such as long core bolts, that extend longitudinally through the core box assembly. Next, the core box assembly is placed into a cope/drag mold. Finally, molten ductile iron is poured into the cope/drag mold and into the core box assembly to cast the crankshaft. Optionally, lightening cores and/or insert weights may be inserted into the core box assembly prior to pouring as previously discussed.

While the best mode for carrying out the invention has been described in detail, those familiar with the art to which this invention relates will recognize various alternative designs and embodiments for practicing the invention as defined by the following claims.

What is claimed is:

1. A metal casting core assembly for casting a crankshaft having a central axis, comprising a plurality of foundry sand cores each having an interior opening for receiving molten metal to each form a different portion of the crankshaft, the sand cores each being aligned along the central axis of the crankshaft and having a plurality of core bolt holes that are aligned as the core assembly is assembled and each of which receive a core bolt that extends parallel to the axis, the core bolts each being secured with a retaining nut to hold the core assembly together with compressive loading.

2. The metal casting core assembly of claim 1 further comprising a plurality of oil gallery cores that are received in the sand cores, the oil gallery cores extending through one of the interior openings to define an oil gallery in the crankshaft.

3. The metal casting core assembly of claim 2 wherein the oil gallery cores are formed of high temperature resin bonded sand.

4. The metal casting core assembly of claim 2 wherein the oil gallery cores have at least one elongated body portion and an anchoring portion on each end of each body portion, the anchoring portions each being received in a cut-out formed in one of the sand cores, the cut-out being shaped to correspond to one of the anchoring portions.

5. The metal casting core assembly of claim 4 wherein the anchors are tapered to form a narrower side that is received in the base of the cut-out and a wider side at a mating surface of the sand core in which the anchoring portion is received.

6. The metal casting core assembly of claim 1 wherein the sand cores each have at least one mating surface that is placed face-to-face with a mating surface of an adjacent sand core.

7. The metal casting core assembly of claim 6 wherein a first set of the mating surfaces have locator pins and a second set of the mating surfaces have locator pin recesses, and wherein one adjacent sand core has locator pins and one adjacent sand core has locator pin recesses that are positioned to receive the locator pins.

8. The metal casting core assembly of claim 1 further comprising at least one insert made of a metal composition that is different than the molten metal used to form the crankshaft.

9. The metal casting core assembly of claim 8 further comprising at least one sand positioning member secured to one of the sand cores and to the insert to retain the insert in one of the interior openings.

10. The metal casting core assembly of claim 1 further comprising:

a first one of the sand cores having the interior opening defining a post end of the crankshaft, a first main bearing journal, and a part of a first counter-weight;

a second one of the sand cores has two sides and having the interior opening on a first side defining a first connecting rod pin and a part of a first counter-weight and on a second side a part of the second counter-weight;

a third one of the sand cores has two sides and having the interior opening defining on a first side a fourth connecting rod pin and a part of the second counter-weight and on a second side part of a third counter-weight;

a fourth one of the sand cores has two sides and having the interior opening defining on a first side a second main bearing journal and a part of the third counter-weight and on a second side part of a fourth counter-weight;

a fifth one of the sand cores has two sides and having the interior opening defining on a first side a second connecting rod pin and a part of the fourth counter-weight and on a second side part of a fifth counter-weight;

a sixth one of the sand cores has two sides and having the interior opening defining on a first side a fifth connecting rod pin and a part of the fifth counter-weight and on a second side part of a sixth counter-weight;

a seventh one of the sand cores has two sides and having the interior opening defining on a first side a third main bearing journal and a part of the sixth counter-weight and on a second side part of a seventh counter-weight;

an eighth one of the sand cores has two sides and having the interior opening defining on a first side a third connection rod pin and a part of the seventh counter-weight and on a second side part of an eighth counter-weight;

a ninth one of the sand cores has two sides and having the interior opening defining on a first side a sixth connecting rod pin and a part of the eight counter-weight and on a second side part of a ninth counter-weight, and further comprising a connecting rod pin lightener sand core being secured to the first side of the ninth core in the interior opening;

a tenth one of the sand cores has two sides and having the interior opening defining on a first side a main bearing journal and a part of the ninth counter-weight and on a second side a part of a flywheel hub; and an eleventh one of the sand cores has the interior opening defining a part of a flywheel hub and a metal in-gate ported to the interior opening and further comprising a flywheel hub pilot bearing lightener core.

11. A method of making a crankshaft for an engine, comprising:

coating sand with a resin;

blowing sand into each of a plurality of core boxes that each form an axial segment of the crankshaft that is radially split from adjacent core boxes of a core box assembly;

setting the resin coated sand in the core boxes;

assembling the plurality of core boxes with oil gallery cores to form a core box assembly;

securing the core box assembly together with elongated fasteners that extend longitudinally through the core box assembly;

placing the core box assembly into a cope/drag mold; and pouring molten ductile iron into the cope/drag mold and into the core box assembly to cast the crankshaft.

12. The method of claim 11 wherein the resin is a urethane resin and wherein the step of setting the resin further comprises injecting a catalyst gas into the core box to set off the resin.

13. The method of claim 12 wherein the catalyst gas is vented through a vent screed.

14. The method of claim 11 wherein the oil gallery cores have body portions and anchoring portions, wherein the body portions extend through an opening in the core box assembly and the anchoring portions are secured to the resin coated sand in at least one core box.

15. The method of claim 14 wherein the oil gallery cores are high temperature resin bonded sand cores.

16. The method of claim 11 further comprising inserting tungsten steel inserts into the core box assembly and supporting the inserts with sand cores during the pouring step.

17. The method of claim 11 further comprising inserting lightening cores into the core box assembly prior to the pouring step.

* * * * *